United States Patent [19]

Masuda

[11] 4,408,250

[45] Oct. 4, 1983

[54] CIRCUIT FOR REMOTELY OPERATING AN ELECTROMAGNETIC RELAY

[75] Inventor: Toshiyuki Masuda, Matsuzaka, Japan

[73] Assignee: Matsushita Denko Kabushiki Kaisha, Osaka, Japan

[21] Appl. No.: 275,850

[22] Filed: Jun. 22, 1981

[30] Foreign Application Priority Data

Jul. 8, 1980 [JP] Japan ..... 55-096686[U]

[51] Int. Cl.[3] ..... H01H 47/22

[52] U.S. Cl. ..... 361/160; 361/208

[58] Field of Search ..... 361/160, 191, 205, 208

[56] References Cited

U.S. PATENT DOCUMENTS 3,794,888 2/1974 Hisano .

4,338,649 7/1982 Mosier ..... 361/191 X

FOREIGN PATENT DOCUMENTS 444113 3/1936 United Kingdom ..... 361/191

*Primary Examiner*—Harry E. Moose, Jr.

*Attorney, Agent, or Firm*—Stevens, Davis, Miller & Mosher

[57] ABSTRACT

A system for controlling an electrical load having a magnetic latching relay operable in response to a change in the direction of current through said relay. A control circuit is provided having a switch with one contact connected to a contact of the relay. A first current path and second current path are supplied to a second contact of the switch. The current paths are enabled when the switch operating member connects the relay to the second contact. One of two current carrying paths are provided between the second contact and a source of electrical voltage. The current paths are enabled in response to the voltage stored on a capacitor connected to the first of said contacts. Depending upon the state of the relay, the proper current path is enabled, permitting a change in state of the relay.

7 Claims, 12 Drawing Figures

CIRCUIT FOR REMOTELY OPERATING AN ELECTROMAGNETIC RELAY

BACKGROUND OF INVENTION

The subject matter of the present application is related to remotely operated electrical switching apparatus. Specifically, new apparatus is described which permits remote switching of a common load into and out of a circuit from multiple locations.

In the past, it has been found useful to arrange lighting circuits, and other electrical loads, to permit the energization of the light from different locations. In installations such as these, first and second switches are located away from the light to be activated. A common relay is connected to each of the switches, the relay being of the latching type. With suitable circuitry interconnecting the light load, a source of power, and the individual control switches, it is possible to activate and deactivate the lighting load from multiple locations.

FIG. 1 is illustrative of one such prior art switching circuit. A latching type relay 12 is energized from a source of electrical voltage 10 when current path 17, 18 or 19 is conductive. Each of the current paths comprises a switch 20 operatively connecting the common side of a power source 10 through one of the back-to-back diodes 27 and 28 to a winding 12*a* of the latching type relay. The latching type relay is equipped with an auxiliary set of fixed contacts 12*b* and 12*c* which are alternately connected to the movable contact 12*b*. The circuit path is completed through back-to-back diodes 14 and 15 to the remaining side of the electrical power source 10.

Thus, with the movable contact 12*d* in the position shown, load 11 remains unenergized. Closure of switch 20 to fixed contact 20*a* permits current to flow through diode 27 thereby energizing relay winding 12*a*. The energization of relay winding 12*a* will close main contacts 12*e* and place movable contact 12*d* into contact with fixed contact 12*b*. At this time, diode 14, because of its polarity, inhibits further current from energizing relay 12*a*.

As FIG. 2 indicates, relay 12 is equipped with a permanent magnet 12*h* which will hold the movable contact in position until a subsequent current is supplied to winding 12*a* in a direction opposite from that previously supplied.

Referring once again to FIG. 1, it is clear that the operation of any of the switches in current path 17, 18, and 19 to connect diode 28 to the one side of power source 10 will permit current flow in the proper sense for opening contacts 12*e* and moving movable contact 12*d* back into connection with fixed contact 12*c*. Light emitting diodes 23, 25, hereinafter LED 23, 25, indicate the present position of movable contact 12*d*. The LED 23, or 25, which is of the same polarity as the diodes 14 or 15 presently in contact with movable contact 12*d*, will be illuminated indicating the state of relay 12.

The difficulty with using apparatus in accordance with FIGS. 1 and 2, is that a simultaneous closure of current path 17 or 18, by operating at the same time a switch located in either of these current paths, will cause multiple changes in the state of relay 12. The associated relay contact bounce provides for arcing on the main contacts 12*e* which reduces the life of the relay 12. Further, this operation will cause a rapid movement in the armature of the relay 12 generating objectionable noise as well as burning the main contacts 12*e*.

A further example of the prior art is shown in FIGS. 3 and 4. Both of these prior art devices employ the use of a capacitor 30, and 32. In the device of FIG. 3, the auxiliary contacts of the magnetic relay 12 are not used. With capacitor 30, the closure of switch 20 to one of the available contacts will permit current to charge capacitor 30. During the charging interval, sufficient current enters relay winding 12*a* to permit the relay to change state. When the load 11 is to be switched again, one of the switches 20 is moved to the opposite contact thereby permitting current of an opposite sense to be supplied to capacitor 30 charging the capacitor in an opposite sense. During this time sufficient current flows through winding 12*a* to permit energization of the relay thereby changing the state of contacts 12*e*.

With the prior art device of FIG. 4, the auxiliary contacts are used with the magnetic relay. Capacitor 32 is charged through resistor 31 to a voltage having a polarity dependent upon the position of movable arm 12*d* of the auxiliary contacts. In the position shown in FIG. 4, capacitor 32 receives a current from diode 14 thereby establishing the shown voltage polarity. If either switch 33 or 34 is closed, the capacitor 32 voltage discharges through the winding 12*a* permitting the relay armature to be moved from its previous position which will move movable contact 12*d* into contact with fixed contact 12*c*. At this time, the reverse voltage polarity is established on capacitor 32 which, upon subsequent activation of switches 33 or 34, will supply current in an opposite direction through winding 12*a* changing the state of the relay contacts.

These examples of the prior art have similar problems when operating switches are continuously actuated at separate locations. The charging and discharging of the capacitors causes an unstable movement in the magnetic latching relay armature. The movement is responsible for arcing and possible fusion of the main contacts 12*e*. Further, there is the problem in the embodiment shown in FIG. 4 that the capacitor can be insufficiently charged when switches are simultaneously activated.

SUMMARY OF INVENTION

It is an object of the present invention to provide for the reliable operation of a magnetic latching relay from multiple locations.

It is a more specific object of the invention to provide a switching circuit for reliably switching a load from multiple locations avoiding any harmful effects as the result of simultaneous switching operations conducted at each of the locations.

These and other objects are accomplished by apparatus in accordance with the present invention. In a load switching apparatus of the type having a latching relay with a main set of contacts for closing and interrupting an electrical circuit, and a pair of auxiliary contacts connected to first and second reversed diodes, a control circuit is provided for energizing the latching relay. The control circuit provides at multiple locations a current completing path. The current completing path in each location is operated in response to the movement of a switch member from a normal position, which biases a capacitor to a voltage dependent upon the relay contact state, to an operating position. When the switch at any location is placed in the operating condition, a current path is provided for the relay winding. The current path is unidirectional and controlled by the bias voltage polarity established on the capacitor.

As the voltage established on a capacitor at each location has the same polarity, determined by the position of the armature of the latched relay, simultaneous operation at more than one location will provide reliable energization of the latch relay.

DESCRIPTION OF THE PREFERRED EMBODIMENT

Figure 1:
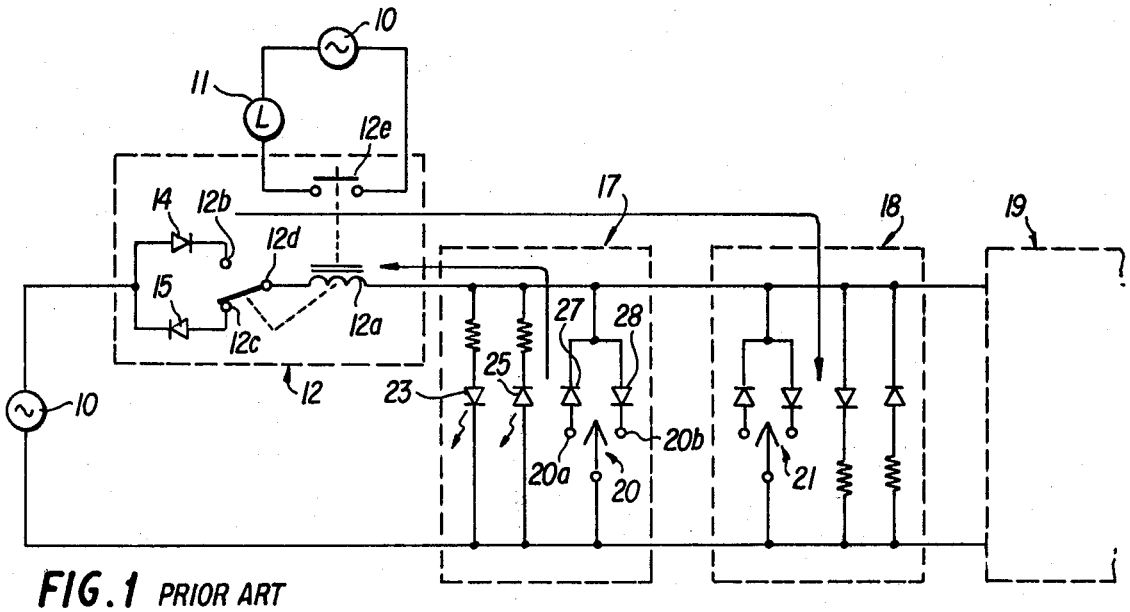
FIG. 1 PRIOR ART
FIG. 1 is illustrative of one prior art apparatus for switching electrical loads from multiple locations.
Figure 2:
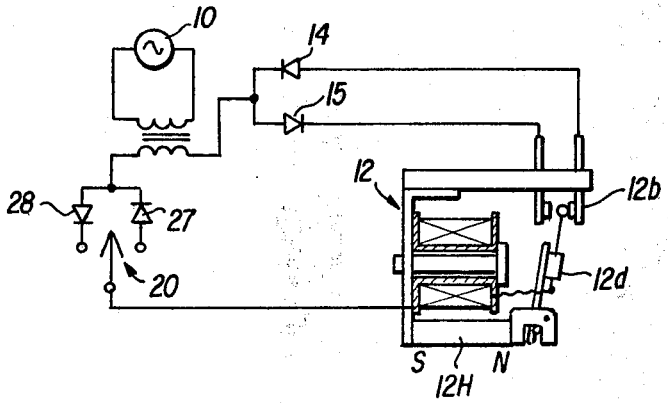
FIG. 2 PRIOR ART
FIG. 2 is illustrative of the magnetic latching relay used in the prior art.
Figure 5:
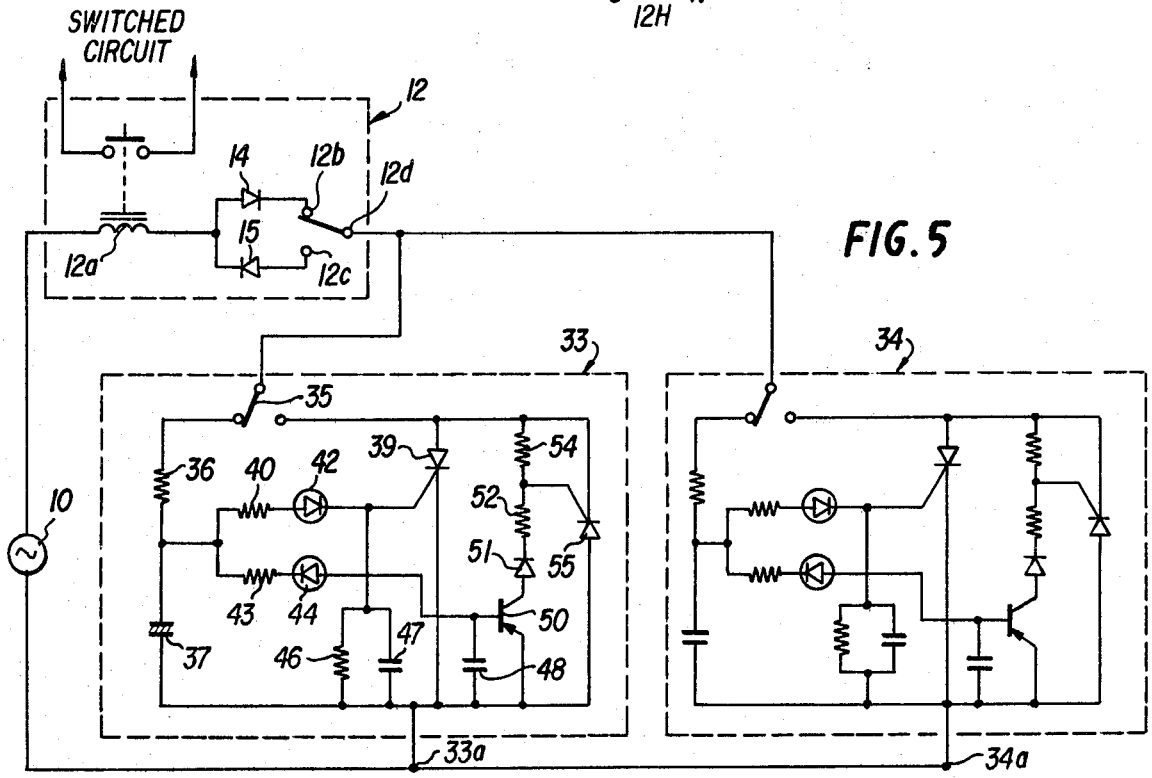
FIG. 5 is a schematic drawing of a preferred embodiment of the invention.
Figure 3:
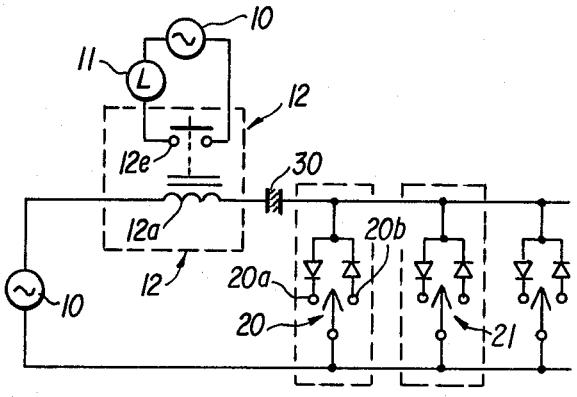
FIG. 3 PRIOR ART
FIG. 3 is yet another apparatus used in the prior art for switching the latching relay from one state to another.
Figure 4:
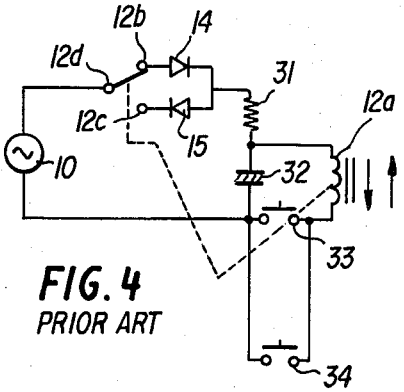
FIG. 4 PRIOR ART
FIG. 4 is yet another example of prior art multiple point switching devices.

Referring now to FIG. 5, these is shown a magnetic latching relay 12 which is remotely energized from at least two locations by circuitry 33, and 34 located at these locations. Magnetic latching relay 12 is of the type used in the prior art to switch an electrical load in and out of a circuit. Relay winding 12*a* is connected at one end to one side of an alternating current power source 10. The remaining end of relay winding 12*a* is connected to diodes 14 and 15. Diodes 14 and 15 are arranged in opposing polarity, the ends of the diodes terminating at the fixed contacts 12*b* and 12*c* of a pair of auxiliary contacts of the relay circuit 12. Movable auxiliary contact 12*d* is connected to circuits 33 and 34. Circuits 33 and 34 have a common terminal 33*a* and 34*a* connected to the remaining side of the power source 10.

Circuit 33, and circuit 34 provide for completing the current path between the relay winding 12*a* through an associated diode 14, or 15, to the power source 10. With the movable contact 12*d* in the position shown, relay 12*a* is energized when the current through winding 12*a* is in the direction of flow permitted by diode 14. Therefore, to energize relay winding 12*a*, either circuit 33 or circuit 34 must provide a current path for current in this aforesaid flow sense.

Referring in detail to circuitry 33, there is shown a switch 35 having a normal position which connects the movable contact 12*d* of the auxiliary contacts for relay 12 to a series connection of a resistor 36 and capacitor 37. When the movable contact 12*b* is in the position shown, capacitor 37 will be charged with a voltage of one polarity. Circuit 34 is identical to circuit 33 but remotely located to permit activation of relay 12 and hence switching of an electrical load from a remote location.

Capacitor 37 retains a DC voltage which is used to enable one of two circuit paths provided in circuit 33. The first circuit path is through a silicon controlled rectifier, hereinafter SCR 39. The second of the available paths is through SCR 55. When the movable contact 12*b* is in the position shown, closure of switch 35 will place the current carrying paths in series with the relay winding 12*a*, diode 14, and power source 10. Because the current through relay 12*a* is restricted to the sense permitted by diode 14, the current path represented by SCR 39 must be enabled. The voltage appearing on capacitor 37 is of the proper polarity to gate SCR 39 through resistor 40 and LED 42 into conduction. Resistor 46 in combination with resistor 40 and LED 42 divide the voltage appearing at capacitor 37 to a level sufficient to permit SCR 39 to be rendered conducting. The SCR 55, being of the opposite current carrying sense, will not be enabled. Capacitors 47 and 48 are transient suppressing circuit elements.

The conducting of current by SCR 39 will therefore cause winding 12*a* to be energized, and movable contact 12*d* to be moved into electrical contact with fixed contact 12*c*. At this time, diode 15 being of the opposite current carrying sense to diode 14, restricts any further current flow through SCR 39. When switch 35 returns to the normal position, capacitor 37 will because of the presence of diode 15, charge to a voltage having a polarity opposite to that previously applied to capacitor 37. A subsequent activation of the switch 35 in either of circuits 33 or 34 will apply the new capacitor voltage through resistor 43, LED 44, and capacitor 48 to the base of transistor 50. Transistor 50, being of the PNP type, will be gated into conduction whereby current will pass from the emitter into the collector. The conduction through the collector emitter circuit of transistor 50, establishes a bias voltage through resistors 54 and 52 to enable the alternate current path represented by SCR 55. In this mode, current will flow through SCR 55 and thence through diode 15 energizing relay winding 12*a* permitting a second change of state to occur in the contacts of relay 12.

LED 42, and 44 indicate the polarity of the voltage on capacitor 37, and hence the particular state of relay 12. As switch 35 is activated, LED 42 and 44 will be alternately illuminated. Thus, it is possible to visually observe when the change of state for the contacts of relay 12 has occurred as a result of the actuation of switch 35. Further, diode 52 will limit any current flow from the base to collector in transistor 50 to a safe value and polarity.

With the embodiment of FIG. 5, the simultaneous operation of switch 35 in either circuit 33 or 34 will not promote the uncertain switching of relay 12. The noise generated by the prior art devices, and the arcing of the main contacts of the relay are avoided.

Figure 6:
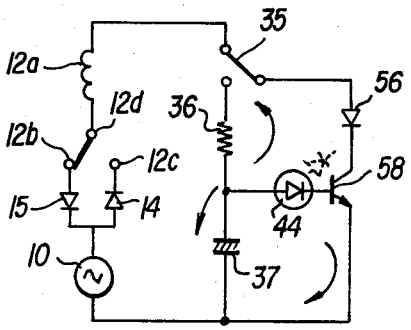
FIG. 6 is illustrative of a switching condition for the apparatus of FIG. 7.
Figure 7:
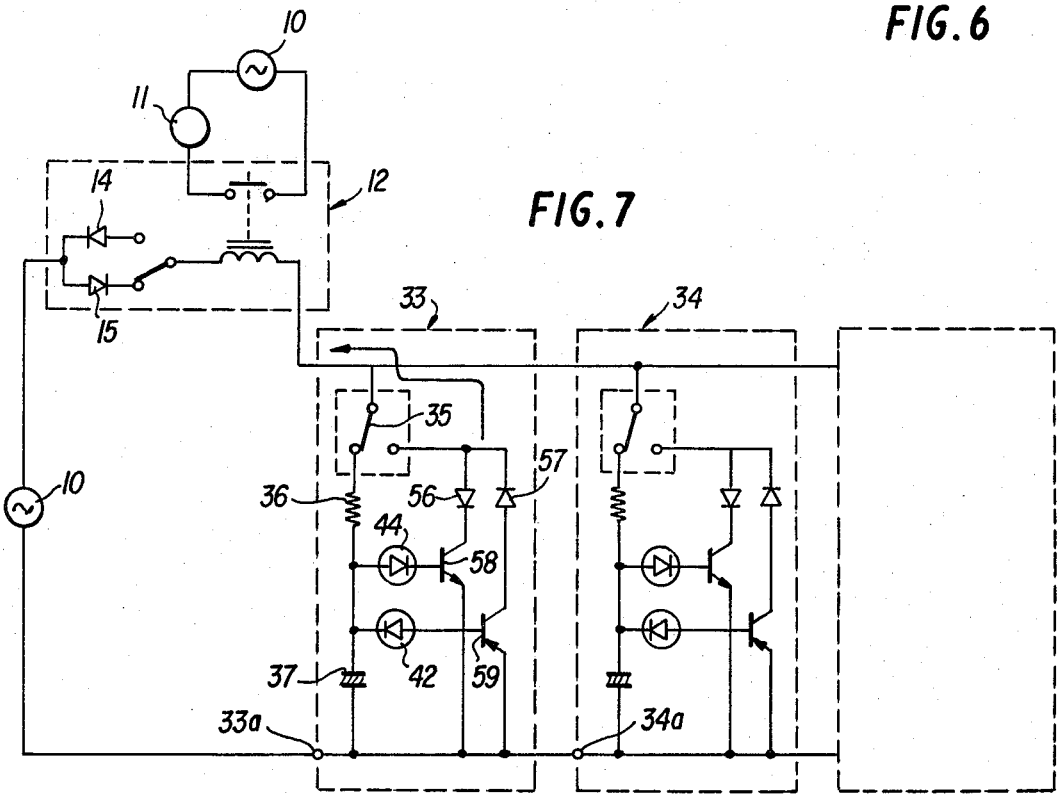
FIG. 7 is illustrative of yet another embodiment of the present invention.
Figure 8:
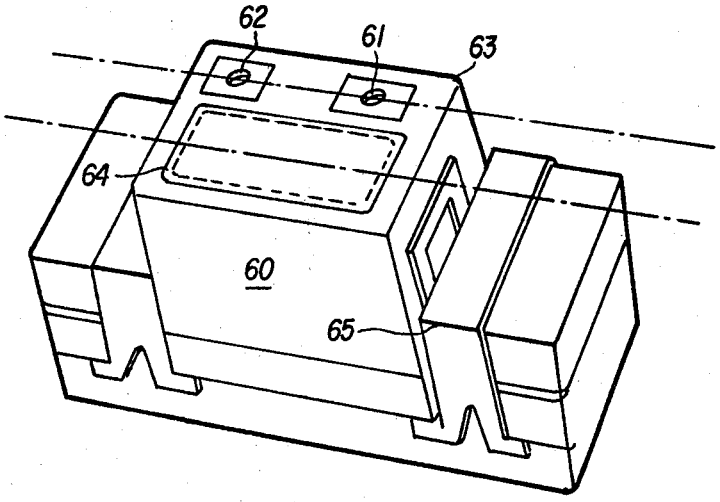
FIG. 8 is a plan view of one packaging arrangement for the invention.
Figure 9:
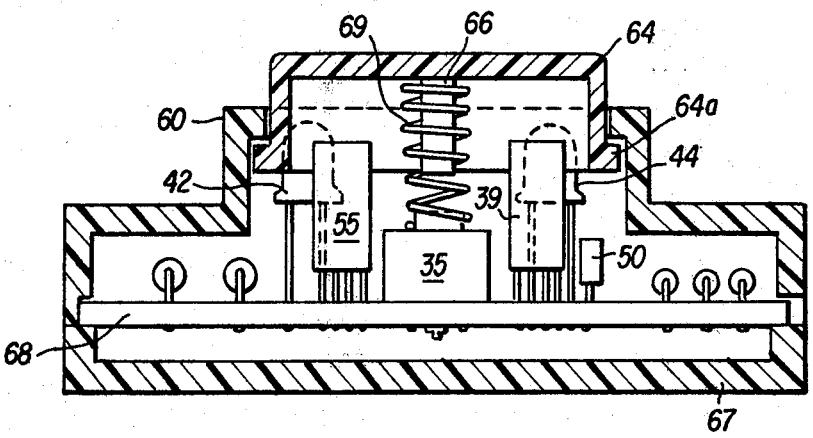
FIG. 9 is a sectional view of the packaging arrangement shown in FIG. 8.
Figure 10:
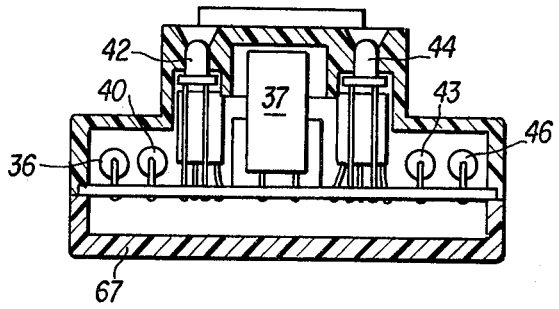
FIGS. 10 and 11 are further views of the packaging arrangement of FIG. 8.
Figure 11:
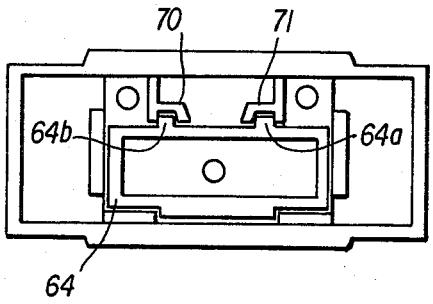
Figure 12:
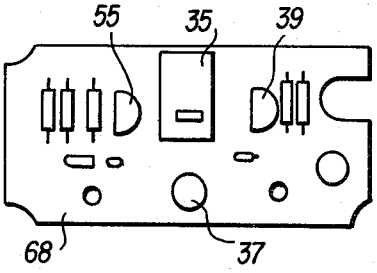
FIG. 12 is a view of the circuit board used to implement one embodiment of the invention in the packaging arrangement of FIG. 8.

A further example of an embodiment in accordance with the invention is shown in FIG. 7. The details of circuit 33, and 34 are different from those of FIG. 5. The current carrying path in each circuit 33, and 34 comprises a diode 56, and NPN transistor 58 for the first current path, and a diode 57, and PNP transistor 59 for the second current carrying path. These two current carrying paths as in the embodiment of FIG. 6 provide current in only one direction in response to the activation of switch 35. Resistor 36 is employed to provide the charging current for capacitor 37. The voltage appearing at capacitor 37 has a polarity depending upon the present state of relay 12, i.e. whether or not diode 14, or diode 15 is supplying the current. FIG. 6 is illustrative of circuit 33 just after the energization of relay 12, whereby movable contact 12*d* has been switched into contact with fixed contact 12*b*. If switch 35 remains in the operate condition, diode 56 will prevent current from flowing through the collector of transistor 58. Thus, $i_\alpha$ does not flow. When switch 35 is left in the operate position, it is still possible to switch the load from the remaining remote locations by operating in circuit 34 the corresponding switch 35. Thus, with an apparatus in accordance with either FIG. 6 or FIG. 7, the switching is dominated by the last switching operation. As in the previous embodiment, LED 44 and 42 indicate the present state of the magnetic latching relay 12.

A packaging arrangement for switching circuits 33, 34 shown in either FIG. 5, or FIG. 7 is shown in FIGS. 8 through 12. A cover 60 in cooperation with a base 67 forms an enclosure for a circuit in accordance with FIG. 5 or 7. A printed circuit board 68 supports the electrical components shown in the aforesaid figures. The top of the cover 60 includes an aperture generally rectangular in shape. Within the aperture is a cap member 64 held within the aperture by a flange 64*a* in cooperation with the cover 60. The cap member 64 includes a projection 66 which is positioned to be in line with an actuator of switch 35. Switch 35 in this packaging arrangement is a momentary switch which upon linear displacement of the actuator moves the movable contact of switch 35 from one fixed contact to another. Smaller apertures 61 and 62 are included in the cover which are in line with LED 42, and LED 44. Therefore, the operator can view the light eminating from either LED 42 or LED 44 to ascertain the particular state of relay 12. The cap member 64 has on its side projections 64*a*, and 64*b* which fit within guide grooves 70, and 71 on the cover 60. Therefore, cap member 64 may freely slide against the bias of spring 69. The structural frame 65 holds the cover 60 to the base member 67. In operation, cap member 64 is depressed against the spring 69. Switch 35 activates one or the other of the unidirectional current paths. These paths supply a current of the proper sense to energize the relay winding 12*a* thereby changing the relay state.

Thus, there has been described with respect to two embodiments apparatus for activating from multiple locations a load switching relay. Those skilled in the art will recognize other embodiments of the invention described in the claims which follow.

What is claimed is:

1. A system for controlling an electrical load comprising:

a magnetic latching relay, said relay comprising a pair of relay control conductors, a load switching pair of contacts, a switch assembly comprising an auxiliary pair of contacts selectively connected to a moving contact and first and second diodes, one end of each of said diodes being connected to a respective one of said auxiliary contacts, the remaining ends of said diodes being commonly connected, said first diode being connected to conduct an electrical current in a direction opposite to an electrical current conducted in said second diode, said switching assembly having a first current carrying conductor defined by the common connection of the diodes and a second current carrying conductor defined by the moving contact, and a control winding, said moving contact and switching contacts having a state determined by the direction of an electrical current in said control winding, one end of said control winding being connected to one of said current carrying conductors, the other end of said control winding being connected to one of said relay control conductors, the other of said current carrying conductors being connected to the other of said relay control conductors;

a control circuit for switching electrical current through said relay control conductors comprising:

a switch having a movable contact, positionable between first and second fixed contacts, said movable contact being connected to one of said relay control conductors;

a common terminal;

a first current path connected between said first contact and said common terminal, said path including a capacitor and resistor;

a second current path connected between said second contact and said common terminal, said second current path comprising first and second silicon controlled rectifiers connected in parallel for carrying current in opposite directions; and means for supplying a control current from said capacitor to control gates of said rectifiers; and means for applying a voltage between said common terminal and a remaining one of said relay control conductors, whereby when said switch movable contact is moved from said first contact to said second contact a current flows through said relay winding changing the state of said relay contacts.

2. A system for controlling an electrical load comprising:

a magnetic latching relay, said relay comprising a pair of relay control conductors, a load switching pair of contacts, a switch assembly comprising an auxiliary pair of contacts selectively connected to a moving contact and first and second diodes, one end of each of said diodes being connected to a respective one of said auxiliary contacts, the remaining ends of said diodes being commonly connected, said first diode being connected to conduct an electrical current in a direction opposite to an electrical current conducted in said second diode, said switching assembly having a first current carrying conductor defined by the common connection of the diodes and a second current carrying conductor defined by the moving contact, and a control winding, said moving contact and switching contacts having a state determined by the direction of an electrical current in said control winding, one end of said control winding being connected to one of said current carrying conductors, the other end of said control winding being connected to one of said said relay control conductors, the other of said current carrying conductors being connected to the other of said relay control conductors;

a control circuit for switching electrical current through said relay control conductors comprising:

a switch having a movable contact, positionable between first and second fixed contacts, said movable contact being connected to one of said relay control conductors;

a common terminal;

a first current path connected between said first contact and said common terminal, said path including a capacitor and resistor connected together at a capacitor-resistor junction;

a second current path connected between said second contact and said common terminal, said second current path comprising first and second current conducting means connected in parallel for respectively carrying current in opposite directions, said first current conducting means being operative to conduct a current in response to a control current of a first sense, said second current conducting means being operative to conduct a current in response to a control current of a second sense; and means for supplying a control current from the junction of said capacitor and resistor to said first and second current conducting means; and means for applying a voltage between said common terminal and a remaining one of said relay control conductors, whereby operation of said switch will enable one of said current conducting means to provide a current to said relay for operating said load switching pair of contacts.

3. The apparatus of claim 2, wherein said first current conducting means comprises a first thyristor connected between said second contact and said common terminal, and said means for supplying a control current comprises a resistance path connecting a control gate of said first thyristor to said capacitor-resistor junction.

4. The apparatus of claim 3, wherein said second means for conducting comprises a second thyristor connected between said second contact and said common terminal in a current carrying sense opposite the current carrying of said first thyristor, and said means for supplying a control current further comprises a bias circuit for supplying current to a control gate of said second thyristor including a switching transistor, for interrupting said bias current, said transistor having a base element connected to receive a current from said capacitor-resistor junction.

5. The apparatus of claim 2, further comprising first and second indicators connected to indicate the state of said relay.

6. The apparatus of claim 5, wherein said indicators comprise a first light emitting diode connected to carry said control current of a first sense, and a second indicator connected to carry said control current of a second sense.

7. The control circuit of claim 2, wherein said means for supplying a control current comprises, for each current conducting means, a transistor having a collector emitter circuit in series with a diode, and a base circuit connected to be energized by a voltage on said capacitor.

* * * * *